US010119345B2

(12) United States Patent
Crane

(10) Patent No.: US 10,119,345 B2
(45) Date of Patent: Nov. 6, 2018

(54) WELL COUPLING CAP APPARATUS

(71) Applicant: Lee Gordon Crane, Thornton, CO (US)

(72) Inventor: Lee Gordon Crane, Thornton, CO (US)

( * ) Notice: Subject to any disclaimer, the term of this patent is extended or adjusted under 35 U.S.C. 154(b) by 72 days.

(21) Appl. No.: 15/230,080

(22) Filed: Aug. 5, 2016

(65) Prior Publication Data

US 2018/0038175 A1 Feb. 8, 2018

(51) Int. Cl.
*E21B 19/16* (2006.01)

(52) U.S. Cl.
CPC ..... *E21B 19/16* (2013.01)

(58) Field of Classification Search
CPC ..... E21B 19/16
USPC ..... 166/93.1, 94.1
See application file for complete search history.

(56) References Cited

U.S. PATENT DOCUMENTS 1,632,889 A * 6/1927 Davis ..... E21B 33/08 15/220.4

* cited by examiner

*Primary Examiner* — Taras P Bemko
(74) *Attorney, Agent, or Firm* — KPPB LLP

(57) ABSTRACT

Methods and apparatuses for preventing the uncontrolled release of fluid materials from a well string during decoupling are provided. The apparatus includes an elongated body having an internal passage running along the longitudinal axis thereof, wherein the internal passage is configured to conform to the outer perimeter of a portion of a pipe and coupling of a well string such that fluid released from the coupled pipes during a decoupling operation is controllably redirected downward.

8 Claims, 4 Drawing Sheets

WELL COUPLING CAP APPARATUS

FIELD OF THE INVENTION

The present invention generally relates to the field of well construction and repair, and more specifically to coupling caps for fluid containment during pipe removal.

BACKGROUND

Well pump and/or motor failure is a continual problem during drilling or operation of a well. In most wells, during operation, the pump and/or motor is installed down well via a "drop pipe". Such drop pipes range in diameter and usually come in 20 to 21 foot lengths. Each length of pipe is threaded on each end and connected to the next length by use of a coupling. During operation, the pump is threaded onto the very last or bottom piece of pipe. In these cases, when the pump and/or motor fails it must be removed from the well and serviced. Typically the pumps and/or motors have a check valve built into them to prevent water from draining out of the pipe after it turns off. Accordingly, when pulling the pump and disconnecting each length of pipe from the next, each section of pipe is filled with water that has been kept in the pipe by the check valve, making the task of decoupling sections of the pipe difficult and messy.

SUMMARY OF THE INVENTION

Many embodiments of the invention are directed to coupling caps configured to contain and redirect the flow of fluid from a decoupled coupling of a well string.

In various embodiments the coupling cap comprises a body having a central passage disposed therethrough, wherein a portion of the central passage is configured to conform to the outer perimeter of the pipe portion of a well string and wherein a portion of the central passage is configured to conform to the outer perimeter of the coupling portion of a well string, such that a portion of a well string may pass therethrough.

In various other embodiments the body of the coupling cap has a slit running along the length thereof such that the body is radially flexible such that the radial dimension of the central passage of the coupling cap is variable.

In still various other embodiments the body of the coupling cap is elongated along its longitudinal dimension, and wherein the central passage of the upper portion of the body has a radial dimension that is smaller than the radial dimension of the central passage of the lower portion of the body.

In yet various other embodiments a securing element is provided about the outer perimeter of the body of the coupling cap such that the body of the coupling cap can be maintained in a configuration wherein the central passage has a reduced radial dimension. In some such embodiments the securing element is a strap, band, clamp, etc. In various other such embodiments a groove is provided in the outer perimeter of the body such that the securing element may fit therein.

In still yet various other embodiments a cover element is provided that is attached or integral to the outer wall of the coupling cap and at least overlaps along a portion of the length of the slit. In many such embodiments the cover element overlaps along the entire length of the slit. In various other such embodiments the inner face of the cover element is provided with an engagement mechanism configured to engage with a cooperative mechanism disposed on the outer wall of the coupling cap to secure a portion of the cover element along the outer wall of the coupling cap. In some such embodiments the engagement mechanism may include a hook and loop mechanism, snaps, latches, etc.

In still yet other embodiments the coupling cap is formed of a partially resilient material, such as a plastic or rubber material.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION

Turning now to the drawings, novel methods and apparatuses for preventing the uncontrolled release of fluid materials from a well string during decoupling are provided. In many embodiments the apparatus comprises an elongated body having an internal passage running along the longitudinal axis thereof, wherein the internal passage is configured to conform to the outer perimeter of a portion of a pipe and coupling of a well string such that fluid released from the coupling during a decoupling operation is controllably redirected downward.

Figure 1A:
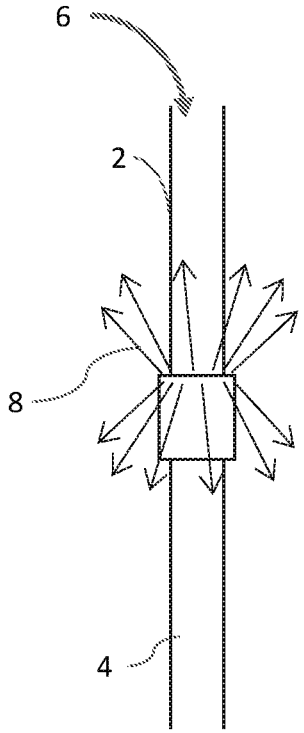
FIG. 1*a* provides a schematic diagram of a conventional pipe coupling, in accordance with embodiments of the invention.
Figure 1B:
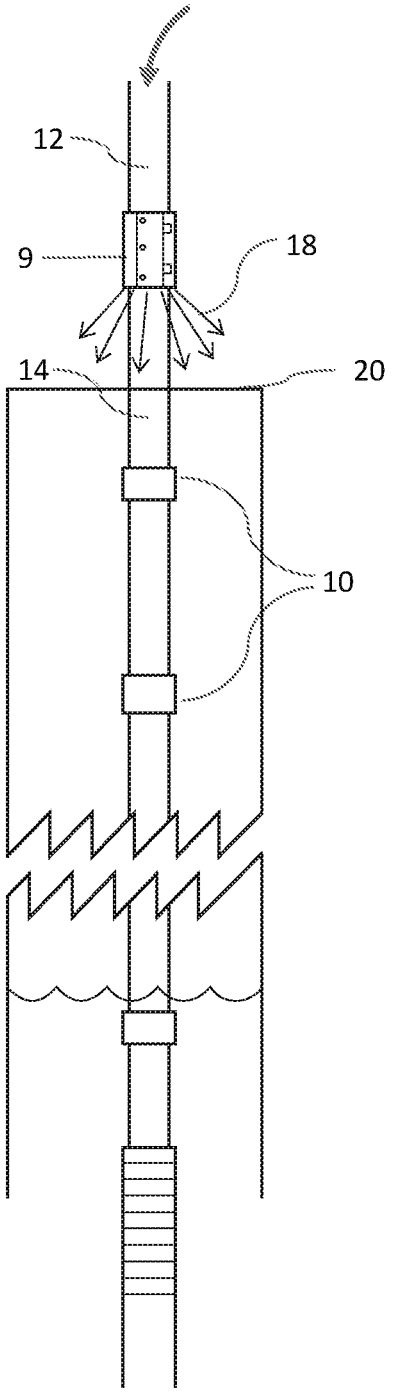
(Prior Art) FIG. 1b
FIG. 1*b* provides a schematic diagram of a well string having a coupling cap disposed atop one of the coupling connections, in accordance with various embodiments of the invention.

As shown in FIG. 1*a*, decoupling two sections of pipe (2 & 4) in a well string (6) is a messy process, because fluid (8) retained in the section of pipe to be decoupled will spray outward uncontrollably. As a result, well workers either are exposed to these uncontrollably released fluids, or must either wear or physically hold a barrier of some kind in front of them to deflect the water as it sprays outward, which limits their freedom of movement. In addition, in inclement weather, such as in cold climates, such uncontrollable release of fluid can result in dangerous working conditions where workers are exposed to cold and wet and where the ground they are working on becomes treacherous with mud and/or ice. Finally, such uncontrollable release of fluids from the pipe string can present an environmental hazard as the fluid is sprayed out into the surrounding land and/or body of water. Various embodiments are directed to coupling clamps (element 9, in FIG. 1*b*) that can be disposed around the coupling point (10) of two sections of pipe (12 & 14) in a string (16) during the decoupling process, and which is configured to redirect the fluid (18) released from the pipe string controllably down and back into the well (20).

Figure 2A:
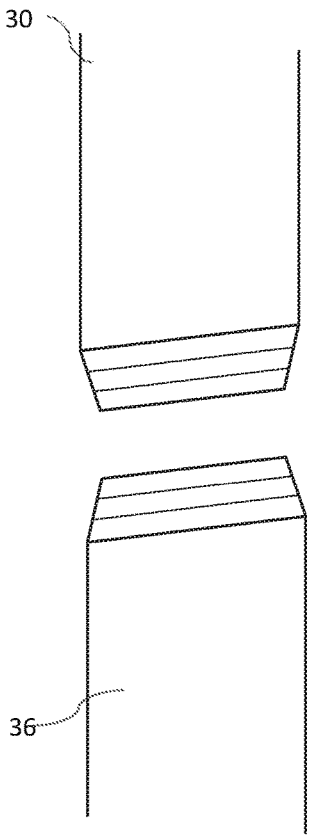
FIGS. 2A and 2B provide a cross-sectional schematic diagram of a coupling cap disposed atop one of the coupling connections, in accordance with various embodiments of the invention.
Figure 2B:
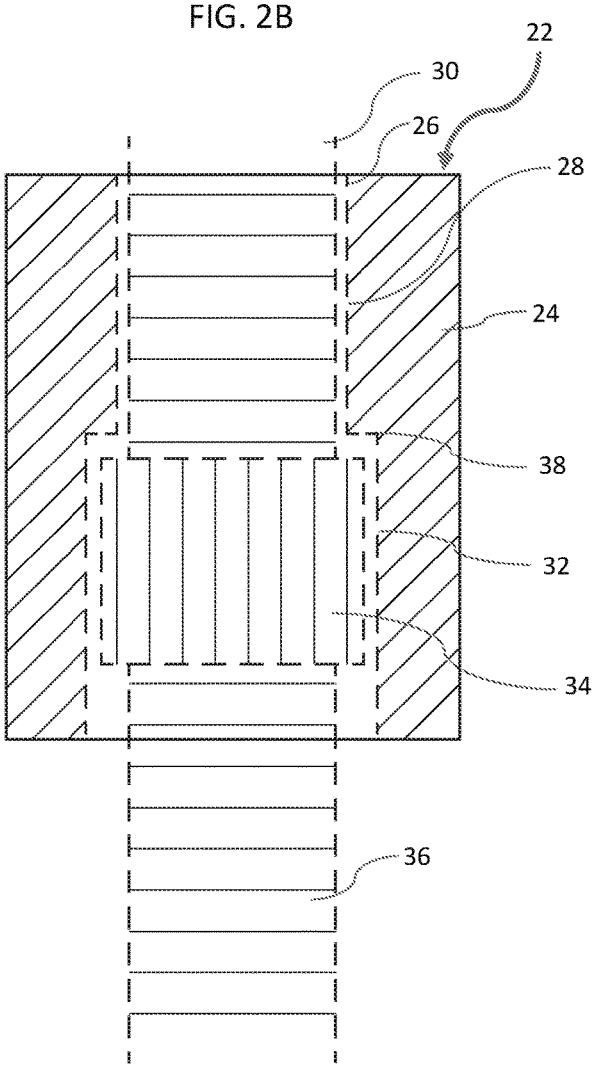

As shown in FIGS. 2A and 2B, in accordance with many embodiments the coupling cap (22) is formed generally of a body (24) having a central passage (26) disposed therethrough. The central passage has a first portion (28) configured to conform to a first pipe segment (30) and a second portion (32) configured to conform to a coupling (34) that joins the first pipe segment to a second pipe segment (36) such that a shoulder is formed (38) that allows the coupling cap to rest atop the coupling and not fall further down the pipe string, and directs the flow of fluid released from the coupling during a decoupling procedure to be controllably directed downward. In many embodiments the upper portion of the passage's diameter is of a slightly larger diameter than the diameter of the pipe it will be used in conjunction with, and the lower portion of the passage's diameter is slightly larger than the coupling diameter such that the coupling cap may be arranged thereabout.

Figure 3:
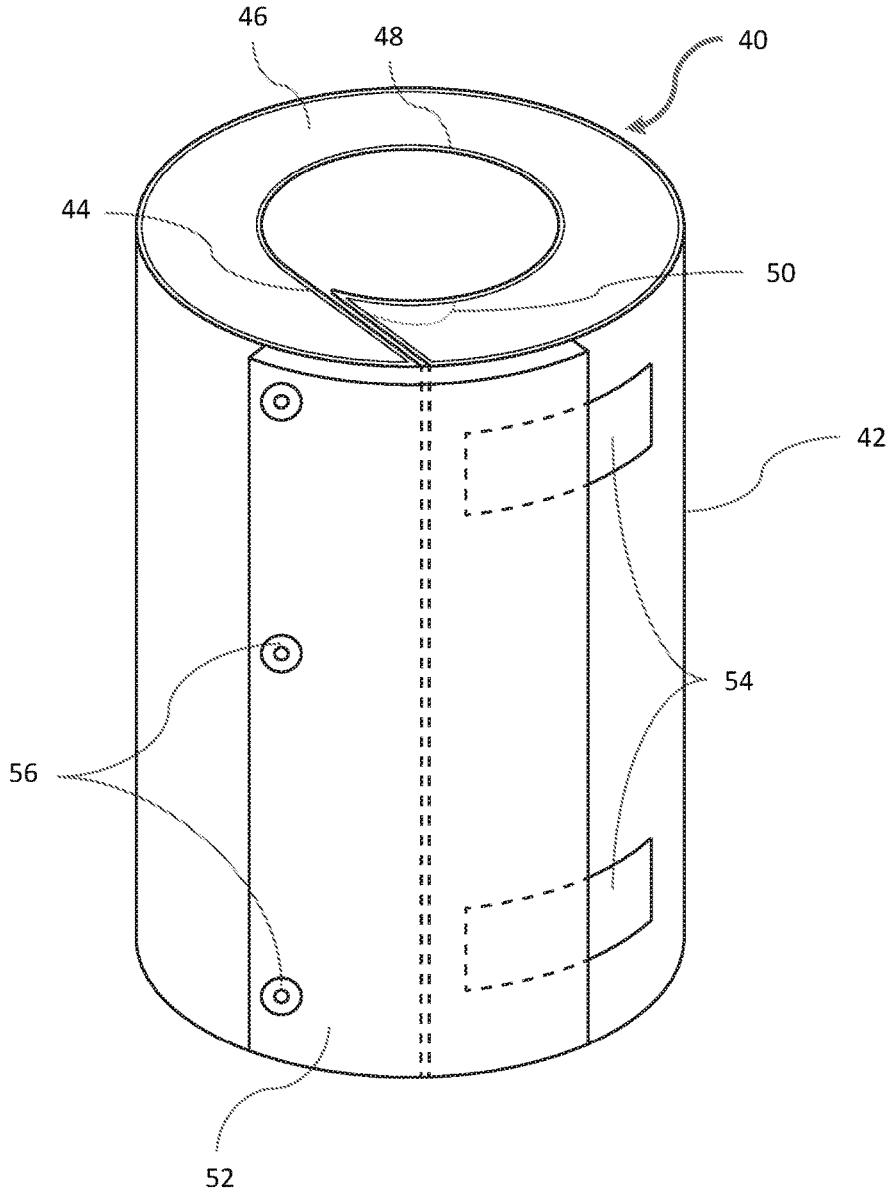
FIG. 3 provides a schematic diagram of a coupling cap, in accordance with various embodiments of the invention.
Figure 4A:
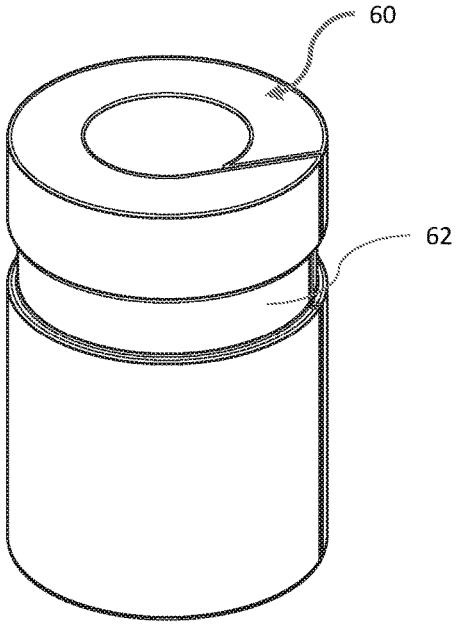
FIGS. 4*a* to 4*d* provide schematic diagrams of a coupling cap, in accordance with various other embodiments of the invention.
Figure 4B:
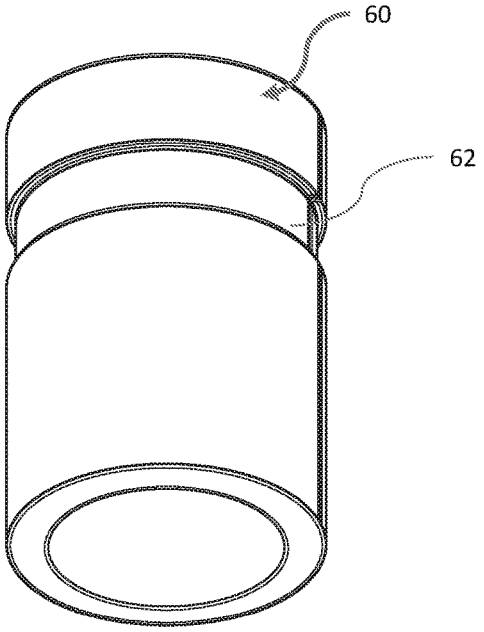
Figure 4C:
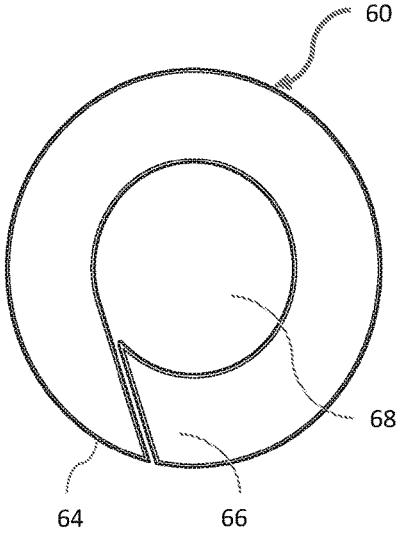
Figure 4D:
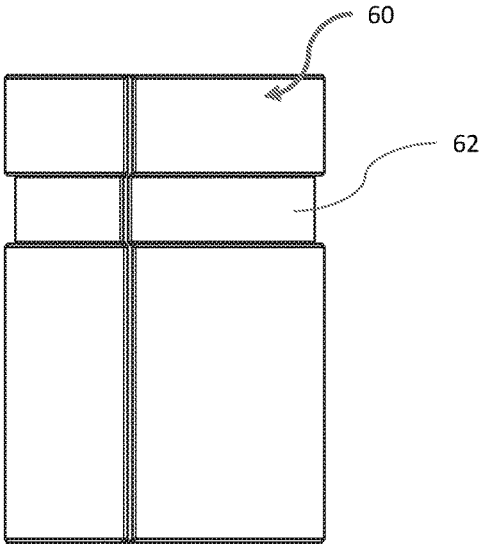

Turning now to the construction of the coupling cap. As shown in FIG. 3, in various embodiments the coupling cap (40) generally consists of a coupling cap body (42) having a central passage running through the length thereof. Although in many embodiments the overall shape of the coupling cap body may be cylindrical, it should be understood that any other suitable shape or configuration may be used such that the coupling cap may be disposed about a desired pipe string during decoupling. As shown, in various embodiments a slit (44) is formed in the body of the coupling cap and runs the vertical length thereof and extends from the outside perimeter (46) of the coupling cap body to the perimeter of the inner passage (48) of the coupling cap body. In many embodiments the slit (44) is formed at an angle (50) tangent to the perimeter of the inner passage. Regardless of the specific angle used, the slit allows the ends of the coupling cap body to move relative to each other such that the coupling cap body may be tightened around the pipe and coupling of the well string during operation.

In many embodiments a slit cover (52) may be provided. Such a slit cover may be integral with the coupling body, or may be formed of a separate piece of material that may be affixed to the coupling cap on one side of the slit via one or more attachment elements (56), such as, for example, screw, latches, tacks, glues, etc. Although the slit cover shown in the figure is of a rectangular shape, in various embodiments this shape may take any form suitable to cover the slit during the use of the coupling cap. In various embodiments, for example, the clit cover may be approximately 0.0125" thick with a total length equal to the coupling cap length, which in some embodiments may be from 4 to 6" wide. The slit cover (40) may have cooperative engagement elements (54) disposed on the inner face of the clit cover and the outer face of the coupling cap body, such that the engagement elements cooperatively engage each other to maintain a specific radial dimension to the passage once in place on the pipe string. Although many different engagement elements may be used (such as, for example, snaps, latches, etc.), in many embodiments a hook and loop mechanism may be used. In such embodiments the hook and loop mechanism may include strips that are glued to the faces of the coupling cap body and slit cover. In some such embodiments, as shown the hook and loop mechanism may run in horizontal strips at different locations along the coupling cap body.

In alternative embodiments, as shown in FIGS. 4*a* to 4*d*, the coupling cap body (60) may include a groove (62) in which a separate tightening element (not shown), such as, for example, a hook and loop, resilient or cinch strap may be disposed to tighten the two ends (64 & 66) of the coupling cap body relative to each other to reduce and maintain a desired radial dimension of the passage (68) during operation.

DOCTRINE OF EQUIVALENTS

As can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What claimed is:

1. A coupling cap comprising:

a body having a central passage with an internal diameter disposed therethrough, wherein an upper portion of the central passage internal diameter conforms to the outer perimeter of a pipe portion of a well string and wherein a lower portion of the central passage internal diameter cooperatively engages to the outer perimeter of a coupling portion of a well string and comprising a shoulder portion which will rest on the coupling portion of a well string, such that a portion of a well string may pass through the body of the coupling cap.

2. The coupling cap of claim 1, wherein the coupling cap body further comprises a slit running along the length thereof such that the body is radially adjustable such that the radial dimension of the central passage of the coupling cap is variable.

3. The coupling cap of claim 2, further comprising a slit cover disposed along the outer wall of the body and configured to overlap at least a portion of the length of the slit.

4. The coupling cap of claim 3 wherein the slit further comprises one or more engagement elements disposed on the inner face of the slit cover and the outer wall of the body to secure a portion of the slit cover to the outer wall of the body.

5. The coupling cap of claim 1 wherein the body of the coupling cap is elongated along its longitudinal dimension, and wherein the central passage of the upper portion of the body has a radial dimension that is smaller than the radial dimension of the central passage of the lower portion of the body.

6. The coupling cap of claim 1 further comprising a tightening element disposed about the outer perimeter of the body of the coupling cap such that the body of the coupling cap is maintainable in a configuration wherein the central passage has a reduced radial dimension.

7. The coupling cap of claim 6, wherein the body further comprises a groove disposed in the outer perimeter thereof and configured such that the tightening element may be disposed therein.

8. The coupling cap of claim 1, wherein the body is formed of a partially resilient material.

* * * * *